US007802457B2

(12) United States Patent
Golovashchenko et al.

(10) Patent No.: US 7,802,457 B2
(45) Date of Patent: Sep. 28, 2010

(54) ELECTROHYDRAULIC FORMING TOOL AND METHOD OF FORMING SHEET METAL BLANK WITH THE SAME

(75) Inventors: Sergey Fedorovich Golovashchenko, Beverly Hills, MI (US); Alan John Gillard, Lincoln Park, MI (US); Douglas Piccard, Ann Arbor, MI (US); Andrey M. Ilinich, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 340 days.

(21) Appl. No.: 12/114,983

(22) Filed: May 5, 2008

(65) Prior Publication Data

US 2009/0272168 A1 Nov. 5, 2009

(51) Int. Cl.
*B21D 26/12* (2006.01)
*B21D 22/12* (2006.01)

(52) U.S. Cl. ..... 72/56; 72/63; 29/419.2; 29/421.2

(58) Field of Classification Search ..... 72/56, 72/57, 63, 430, 706, 707; 29/419.2, 421.1, 29/421.2
See application file for complete search history.

(56) References Cited

U.S. PATENT DOCUMENTS 3,222,902 A * 12/1965 Brejcha et al. ..... 72/56
3,232,086 A * 2/1966 Kiyoshi ..... 72/56
3,248,917 A 5/1966 Herring, Jr.
3,253,442 A 5/1966 Grove, Jr. et al.
3,267,710 A * 8/1966 Kiyoshi ..... 72/56
3,358,487 A * 12/1967 Brejcha et al. ..... 72/56
3,394,569 A 7/1968 Smith
3,416,128 A 12/1968 Allen
3,423,979 A 1/1969 Smith et al.
3,486,062 A 12/1969 Schrom
3,491,564 A 1/1970 Hundley et al.
3,512,384 A 5/1970 Inoue
3,553,434 A 1/1971 Murray
3,559,435 A 2/1971 Gerber
3,566,645 A 3/1971 Lemelson (Continued)

FOREIGN PATENT DOCUMENTS

GB 1068440 5/1967

(Continued)

OTHER PUBLICATIONS

"Optimization of Initial Blank Shape Predicted Based on Inverse Finite Elelment Method", Science Direct, Finite Elements in Analysis and Design 43 (2007), pp. 218-233.

(Continued)

*Primary Examiner*—David B Jones
(74) *Attorney, Agent, or Firm*—Raymond L. Coppiellie; Brooks Kushman P.C.

(57) ABSTRACT

An electrohydraulic forming (EHF) tool and a method of forming a sheet metal blank in an EHF operation. The tool may include a pair of electrodes and may be filled with a liquid. A high voltage discharge may be produced between the electrodes in a manner that induces a shockwave within the fluid. The shockwave may produce sufficient force within the liquid to form the blank against a die.

20 Claims, 4 Drawing Sheets

U.S. PATENT DOCUMENTS

| | | | | |
|---|---|---|---|---|
| 3,566,647 | A * | 3/1971 | Kiyoshi | 72/56 |
| 3,572,072 | A | 3/1971 | Hundley et al. | |
| 3,575,631 | A | 4/1971 | Pratt | |
| 3,591,760 | A | 7/1971 | Inoue | |
| 3,593,551 | A | 7/1971 | Roth | |
| 3,603,127 | A | 9/1971 | Seiffert et al. | |
| 3,640,110 | A | 2/1972 | Inoue | |
| 3,742,746 | A | 7/1973 | Erlandson | |
| 3,814,892 | A | 6/1974 | Inoue | |
| 3,894,925 | A | 7/1975 | Inoue | |
| 4,030,329 | A | 6/1977 | Chachin et al. | |
| 4,942,750 | A | 7/1990 | Conaway | |
| 5,911,844 | A | 6/1999 | Benedyk | |
| 5,948,185 | A | 9/1999 | Krajewski et al. | |
| 6,033,499 | A | 3/2000 | Mitra | |
| 6,094,809 | A * | 8/2000 | Grassi | 29/802 |
| 6,215,734 | B1 | 4/2001 | Moeny et al. | |
| 6,227,023 | B1 | 5/2001 | Daehn et al. | |
| 6,349,467 | B1 | 2/2002 | Karafillis et al. | |
| 6,519,992 | B1 | 2/2003 | Schnupp | |
| 6,591,649 | B1 * | 7/2003 | Gafri et al. | 72/56 |
| 6,615,631 | B2 | 9/2003 | Kleber et al. | |
| 6,947,809 | B2 | 9/2005 | Ren et al. | |
| 7,130,708 | B2 | 10/2006 | Wang et al. | |
| 7,165,429 | B2 | 1/2007 | Steingroever | |
| 7,240,532 | B2 | 7/2007 | Zhang et al. | |
| 7,266,982 | B1 | 9/2007 | Guza | |
| 7,493,787 | B2 * | 2/2009 | Golovashchenko et al. | 72/63 |
| 2005/0113722 | A1 | 5/2005 | Schultheiss | |
| 2005/0199032 | A1 | 9/2005 | Krajewski | |
| 2006/0201229 | A1 | 9/2006 | Zhu et al. | |

FOREIGN PATENT DOCUMENTS

| | | |
|---|---|---|
| GB | 1095276 | 12/1967 |
| GB | 1165902 | 10/1969 |
| GB | 1241343 | 8/1971 |
| GB | 1244922 | 9/1971 |
| GB | 1250901 | 10/1971 |
| GB | 1252997 | 11/1971 |
| GB | 1262072 | 2/1972 |
| GB | 1294240 | 10/1972 |
| RU | 2158644 | 11/2000 |

OTHER PUBLICATIONS

"General Motors' Quick Plastic Forming Process", James G. Schroth, TMS (The Minerals, Metals & Materials Society), 2004, pp. 9-20.

FY 2005 Progress Report, Automotive Lightweighting Materials, pp. 136-140.

"Demonstration of the Preform Anneal Process to Form a One-Piece Aluminum Door Inner Panel", Lee et al., SAE Technical Paper Series, No. 2006-01-0987, 2006 SAE World Congress, Detroit, MI, Apr. 3-6, 2006.

"Retrogression Heat Treatments in AA6111" Paul E. Krajewski, General Motors R&D Center, Materials and Processing Laboratory, Oct. 23, 2002.

"Metal Forming with Capacitor Discharge Electro-Spark", E.C. Schrom, Paper SP62-80, published in Advanced High Energy Rate forming. Book II, ASTME, 1962.

"Research in Electric Discharge Forming Metals", R.L. Kegg et al., Paper SP62-78, published in Advanced High Energy Rate Forming, Book II, ASTME, 1962.

"Formability of Sheet Metal with Pulsed Electromagnetic and Electrohydraulic Technologies", S.F. Golovashchenko, et al., Proceedings of TMS Symposium "Aluminum-2003", San Diego, CA 2003.

"The Effect of Tool/Sheet Interaction in Damage Evolution of Electromagnetic Forming of Aluminum Alloy Sheet", J. Imbert et al, Transactions ASME, Journal of Engineering Materials and Technology, Jan. 2005, vol. 127, pp. 145-153.

"Equipment and Technological Processes with the Employment of Electrohydraulic Effect" G.A. Guliy, et al., Moscow: Mechanical Engineering, 1977.

"Electrohydraulic Effect and Some Potential Applications", L.A. Yutkin, St. Petersburg, 1959.

Concurred: Project Leader of MSTC Project N 1593—Mar. 31, 2003

"Technical Report on Scientific Research Project: Development of the Technology of Static-Electrohydropulsed Drawing on the Punch of Parts of Boxed Shape", Town of Sarov, 2003.

"Heat Treating, Cleaning and Finishing", Metals Handbook, 8th Ed., vol. 2, Amer.Soc.for Metals, pp. 277-278.

"Plants That Have Tough Metals and Large Parts To Form Watch Cautiously As . . . High Velocity Takes Off Again", J. E. Sandford, Iron Age Technical Features, Mar. 4, 1969, vol. 203, pp. 91-95.

* cited by examiner

ELECTROHYDRAULIC FORMING TOOL AND METHOD OF FORMING SHEET METAL BLANK WITH THE SAME

The present invention relates to an electrohydraulic forming (EHF) tool and a method of forming a sheet metal blank in an EHF operation.

BACKGROUND

Aluminum alloys and advanced high strength steels are becoming increasingly common as materials used in automotive body construction. One of the major barriers to wider implementation of these materials is their inherent lack of formability as compared to mild steels. Incorporating lightweight materials such as advanced high strength steels (AHSS) and aluminum alloys (AA) into high-volume automotive applications is critical to reducing vehicle weight, leading to improved fuel economy and reduced tailpipe emissions. Among the most significant barriers to the implementation of lightweight materials into high-volume production are stamping issues and the lack of intrinsic material formability in AHSS and AA.

Numerous stamping challenges are associated with the implementation of AHSS and AA in automotive production. The primary method of stamping body panels and structural parts is forming sheet material between a sequence of two sided dies installed in a transfer press or a line of presses. During the era of low oil prices, most automotive parts were stamped from Deep Drawing Quality (DDQ) steel or even Extra Deep Drawing Quality (EDDQ) steel, with both alloys exhibiting a maximum elongation in plane strain above 45%. The formability of aluminum alloys, on the other hand, typically does not exceed 25%. In practice, stamping engineers do not intend to form sheet metal beyond a level of 15% in plane strain due to the much lower work-hardening modulus of metals in these strain ranges, and also due to the danger of local dry conditions on the blank surface. The formability of AHSS is typically around 30%. Insufficient formability drives the necessity to weld difficult to form panels from several parts or to increase the thickness of the blank used in forming the panels.

Electrohydraulic forming (EHF) is a process which can significantly increase sheet metal formability by forming a sheet metal blank into a female die at high strain rates. The high strain rate is achieved by taking advantage of the electrohydraulic effect, which can be described as the rapid discharge of electric energy between electrodes submerged in water and the propagation through the water of the resulting shockwave—a complex phenomenon related to the discharge of high voltage electricity through a liquid. The shockwave in the liquid, initiated by the expansion of the plasma channel formed between two electrodes upon discharge, is propagated towards the blank at high speed, and the mass and momentum of the water in the shockwave causes the blank to be deformed into an open die that has a forming surface. The shockwave forces the blank into engagement with the forming surface to form the metal blank into the desired shape.

DRAWINGS

The present invention is pointed out with particularity in the appended claims. However, other features of the present invention will become more apparent and the present invention will be best understood by referring to the following detailed description in conjunction with the accompany drawings in which:

DESCRIPTION

Figure 1:
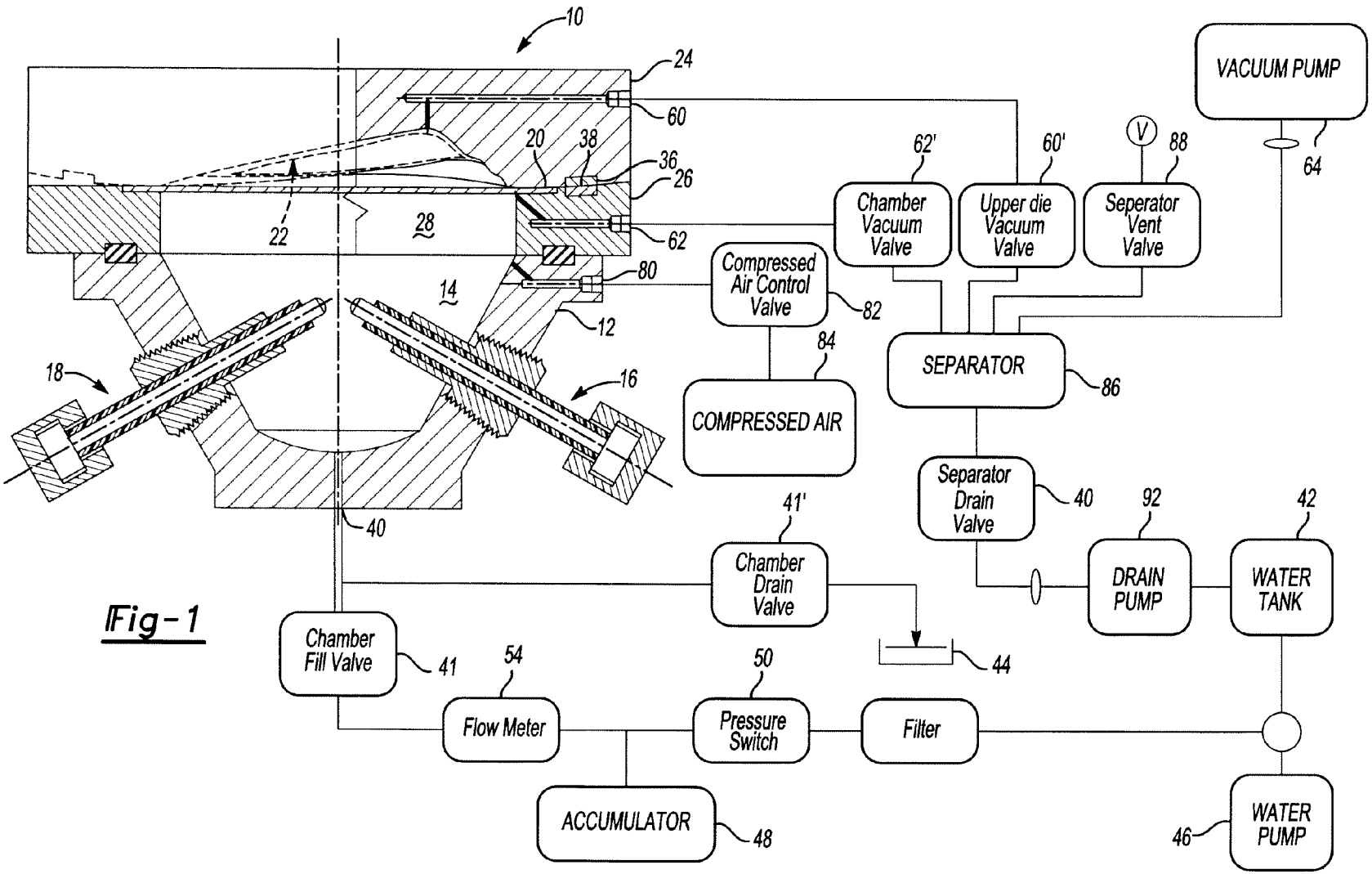
FIG. 1 illustrates an Electrohydraulic Forming (EHF) tool in accordance with one non-limiting aspect of the present invention.

FIG. 1 illustrates an Electrohydraulic Forming (EHF) tool 10 in accordance with one non-limiting aspect of the present invention. The tool 10 may include a vessel 12 defining a vessel cavity 14. At least a pair of electrodes 16, 18 may extend into the vessel cavity 14. A liquid, such as but not limited to water, may be included within the vessel cavity 14. The electrodes 16, 18 may generate an electric potential sufficient to induce a shockwave. The shockwave may propagate through the liquid and deliver a pressure pulse to a blank 20. Preferably, the shockwave produces a force sufficient to deform the blank 20 against a forming surface 22 defined by a cavity in a die 24.

A binder 26 defining a binder cavity 28 may optionally be included between the die 24 and the vessel 12. The binder 26 may be configured to facilitate placement and orientation of the blank 20 relative to the vessel 12 and die 24. Corresponding sealing grooves 36 may be provided between the vessel 12, binder 26, and die 24. These grooves 36 may be filled with a resilient element 38 having properties sufficient to prevent and/or limit fluid leakage from the tool 10. The binder 26 is shown to include a relatively flat upper surface for exemplary purposes. The binder 26 may include a three-dimensionally shaped upper surface having undulations or other contours. This shaping of the binder 26 can be helpful in positioning non-uniformly shaped blanks. The binder 26 is shown as a separate feature but it may be eliminated and/or integrated with either one of the vessel 12 or die 24.

Figure 2:
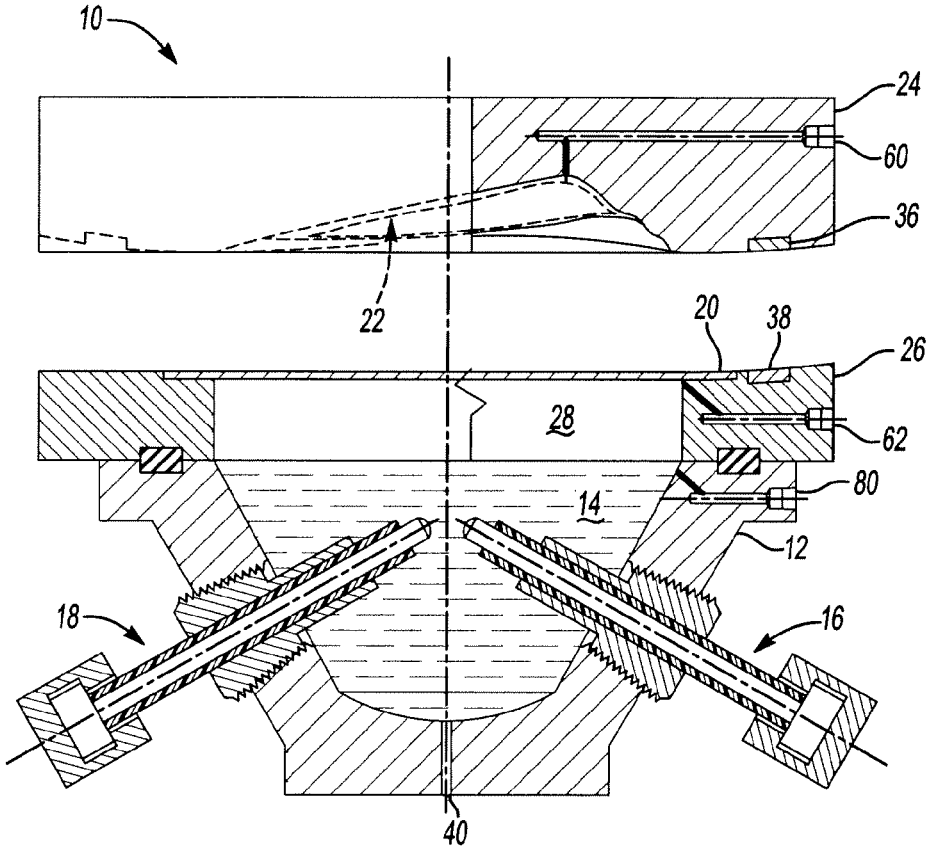
FIG. 2 illustrates the tool being opened in accordance with one non-limiting aspect of the present invention.

FIG. 2 illustrates the die 24 being opened to facilitate positioning and/or removing the blank 20. A press or other means may be used to manipulate the die 24 and blank 20. The liquid may be filled to a level just below an upper end of the vessel 12 to limit the likelihood of spillage. It may also be advantageous to fill the binder cavity 28 to a level just below its upper end. This may be done before or after the blank 20 is positioned.

A liquid supply port 40 and valves 41, 41' may operate in cooperation with a liquid source 42. A controller (not shown) or operator may control the port 40 and source 42 to controllably add and remove liquid from the vessel 12. The liquid supply port/valve 40 may be included at a bottom end of the vessel 12 to facilitate drainage of the liquid to a tank 44. The liquid source 42 may include the water tank 44 and a pump 46. An accumulator 48 may operate with the water tank 44 and pump 46 to facilitate discharging liquid at a quicker rate and/or greater pressure than the tank 44 and pump 46 acting alone. A pressure switch 50 may be used to control a pressure of the liquid within the tool 10. A flow meter 54 may be included to monitor the flow of liquid into and out of the tool 10.

Figure 3:
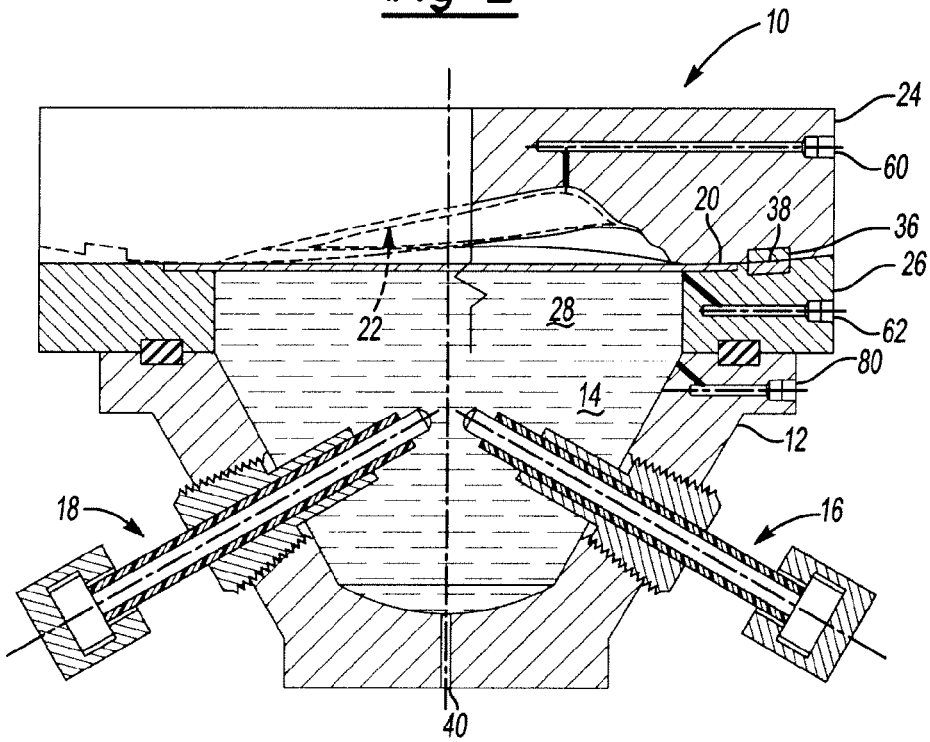
FIG. 3 illustrates the tool being closed in accordance with one non-limiting aspect of the present invention.

FIG. 3 illustrates the tool 10 after closing the die and filling the binder cavity 28. Prior to filling the liquid to the blank 20, air evacuation ports 60, 62 and valves 60', 62' included at an upper most elevation of each of the binder and die cavities may be used in cooperation with a vacuum source 64 to evacuate air from either side of the blank 20. The ability to create a vacuum on either side of the blank can be helpful in maximizing the efficiency of the stamping process. Optionally, the air from each side of the blank 20 may be evacuated in concert so that the forces on each side of the blank 20 are relatively balanced. This can be helpful in preventing the blank 20 from unintentionally deforming while fluid is being evacuated.

The tool 10 may be filled with liquid once or while the air is evacuated. The tool 10 may be filled with liquid until the liquid begins to press against the blank 20. The pressure of the liquid against the blank 20 may be controlled to a desired pressure. The pressure may be selected based on the material, size and other parameters of the blank 20. The pressure may be increased to an extent sufficient to deform the blank 20. This pre-forming may be helpful in forming at least a portion of the blank 20 before it is stamped with the shockwave. This can be helpful in limiting the number of pulses and the load on the die 24 and vessel 12. The pre-forming may also be helpful in limiting cycle times since it may limit the number of shockwave steps used to stamp the blank 20.

Figure 4:
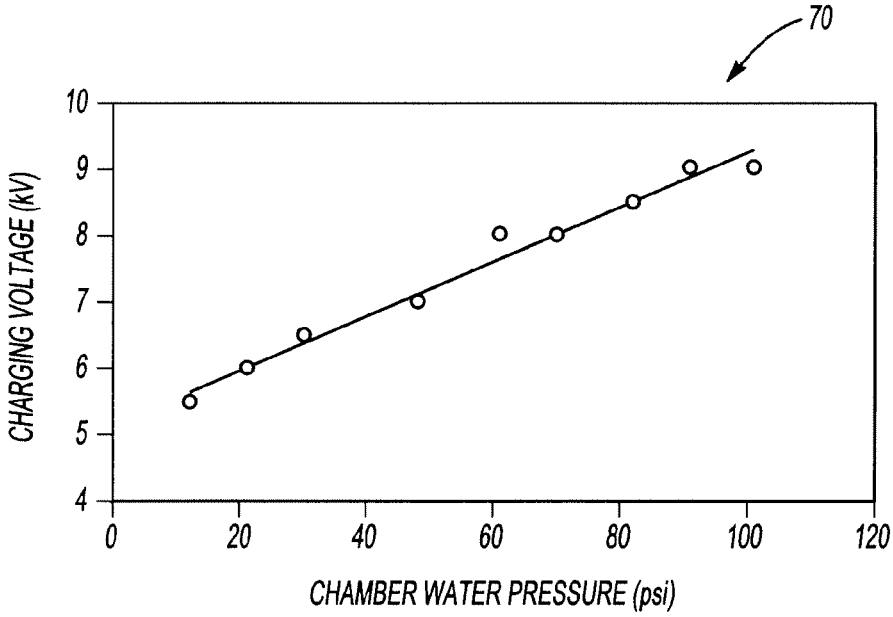
FIG. 4 illustrates a minimum voltage versus pressure graph for the EHF process.

Once the tool 10 is filled with a sufficient volume of liquid, the electrodes 16, 18 may be controlled to induce the desired shockwave. If the blank 20 is pre-formed or if the liquid is otherwise maintained at too high of a pressure, the efficiency of the EHF process may be negatively influenced. FIG. 4 illustrates a minimum voltage versus pressure graph 70 for the EHF process. The graph 70 demonstrates the relationship between electrode voltage and the liquid pressure. (More voltage is required to properly induce the shockwave when the tool maintains the liquid at higher pressures.) An embodiment of the present invention contemplates bleeding the liquid after the pre-forming stage or otherwise controlling the liquid pressure to a desired pressure before inducing the shockwave. This can be helpful in maximizing the efficiency of the EHF process.

Figure 5:
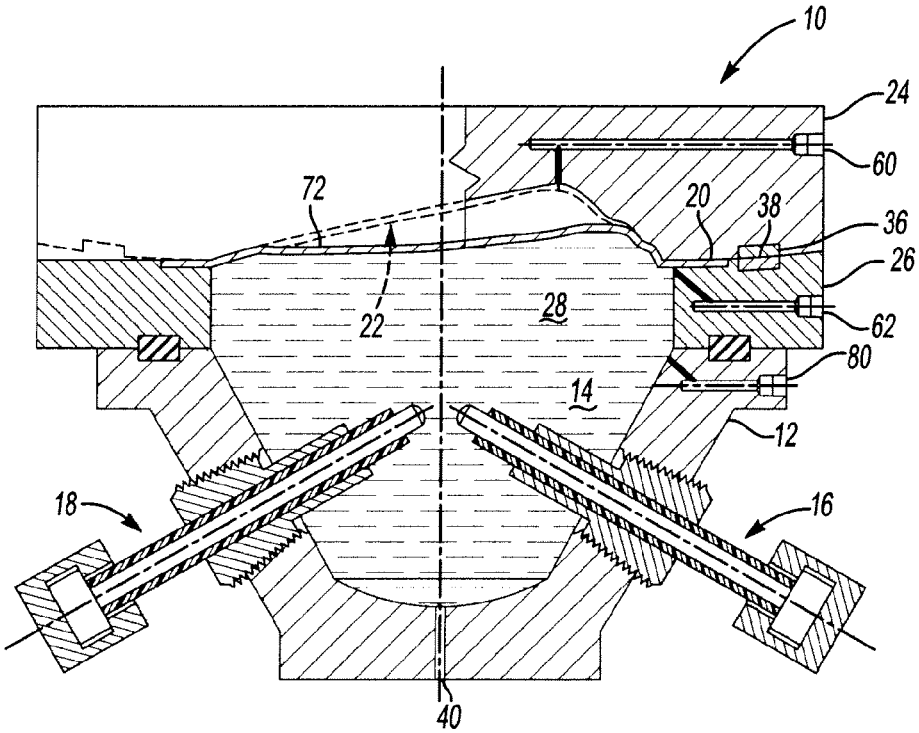
FIG. 5 illustrates the tool after a shockwave in accordance with one non-limiting aspect of the present invention.

FIG. 5 illustrates the tool 10 after another shockwave forms the blank against a first portion 72 of the die 24. Rather than forming the entire blank 20 at the same time, it may be formed with successive shockwaves. The numbers and strength of the shockwaves may vary according to the shape of the die 24, the material of the blank 20, etc. FIG. 5 illustrates the liquid being re-filled to an area under the blank 20. This area may be referred to as a forming cavity.

With each successive pulse the blank 20 is formed further and further into the die cavity 24, thus creating a larger cavity volume below the blank 20. Without the ability to back-fill the chamber with water after each pulse, this extra volume would be occupied by a pocket of low pressure air and water vapor that would be compressed and heated with each subsequent pulse, thereby substantially reducing the pressure that is delivered to the blank. The accumulator 48 can be used to back fill water added through the use of an appropriate water supply connected to the tool 10 through tubing and ports, and controlled by valves. The air may be evacuated from the area above and/or below the blank 20 prior to re-filling it with liquid. The re-filling process may also be completed at pressure in order to pre-form the part 20. The pressure may then be regulated, with or without the pre-forming, in anticipation of the next shockwave.

Figure 6:
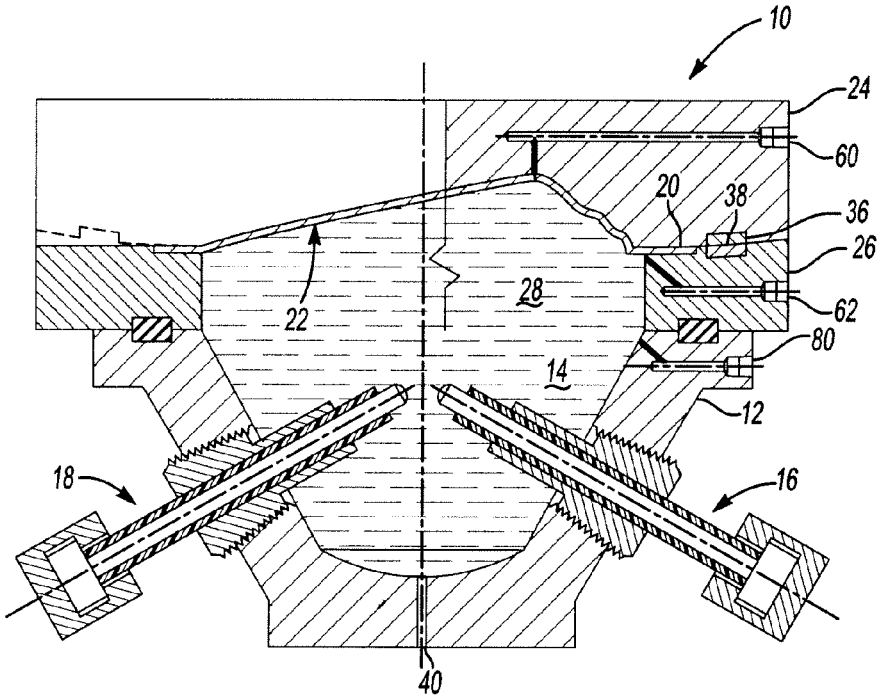
FIG. 6 illustrates the tool after another shockwave in accordance with one non-limiting aspect of the present invention.

FIG. 6 illustrates the tool 10 after a last shockwave forms the blank into its final condition. Each shockwave cycle may optionally include any combination of the above described re-filling, pre-forming, and bleeding steps or none of the steps. Any number of forming pulses (shockwaves) may be required to form a part properly since a single pulse with too much energy can easily rupture the blank 20 or damage the die 24 (the energy of each forming pulse is controlled by adjusting the charging voltage for the capacitors, or more specifically). The blank 20 may be removed once it is formed to its final condition. It may be desirable to remove some of the liquid from the tool 10 before opening the die and removing the blank.

As shown in FIG. 5, the liquid level may rise above the binder 24 during the forming process. The liquid could spill from the tool 10 if the blank 20 were removed under these conditions. Depending on whether the binder 26 is to be removed before the next forming process, the liquid may be drained to a level below the top of the binder 26 or a level below the top of the vessel 12. A fluid supply port 80 and valve 82 may be operatively connected to a fluid source 84, such as but not limited to source of compressed air, to pressurize the liquid. This pressurization may be helpful in forcing drainage of the liquid from the tool 10 and facilitating removal of the finally formed blank 20. The ports 60, 62 may also be connected with a separator 86 to a source of atmosphere pressure 88, which can be helpful in equalizing pressure on either side of the blank 20. Any liquid received through the separator 86 can be returned with valve 90 to drain pump 92 for subsequent delay to the water tank 44.

In some cases it may be difficult to determine with desired precision whether the blank 20 was actually formed to its final shape or whether additional forming stages are needed. An embodiment of the present invention contemplates monitoring the amount of fluid within the tool 10 in an effort to assess whether the blank 20 was formed to its final shape. Depending on the shape of the die 24, the amount of fluid added to the tool after each forming stage should decrease over time until there is no more room within tool 10 to receive fluid, i.e., until the blank 20 is matched to the shape of the die 24. Once the addition of water ceases it may be determined that the blank 20 has been formed to its final shape and matches the die.

The amount/flow of liquid may also be used to assess previous forming stages. If past history indicates a certain amount of liquid is typically added after a particular forming stage, that amount of liquid can be used as a benchmark for judging a corresponding forming stage. If too little liquid was introduced, it may be assumed that the blank 20 was under-formed and if too much liquid was introduced, it may be assumed that the blank 20 was over-formed. Because of the liquid levels and the 'black box' nature of the tool, it may be difficult to visually inspect the forming of the die and/or to sense its formation. Reliance of the amount of liquid can help ameliorate this issue. An additional flow meter may be used to measure the amount of drained water before opening the press.

The entire EHF system on one non-limiting aspect of the present invention may be a combination of several sub-systems, comprising a pulsed current generator, a hydraulic press used for clamping dies together, the water/air management system, and the integrated hydroforming system. All three of these sub-systems may exist as stand-alone units, with each having its own set of independent push-button controls. The main function of the water/air management system is to deliver water to the electrode chamber and to apply vacuum to the volume between the die and blank. The die and electrode chamber may be mounted in a press. The press can clamp the die and binder attached to the electrode chamber together and the edges of the blank prior to forming to act as a binder or lock and also as a sealing system. The vacuum pump can work in concert with the water delivery step to completely fill the electrode chamber with water. The water/air management system can also partially drain the electrode chamber at the end of the forming process to a level just below the upper rim of the chamber so that the die can be opened without spillage.

The water/air management system may consist of a water supply tank, a supply pump, a water filter, a drain pump, a water accumulator, several flow meters, and vacuum components. The vacuum components can consist of a liquid ring vacuum pump, a water separator, and associated valves and piping. These sub-systems may be operated by solenoid valves, and controlled remotely. The separator prevents delivery of excess liquid water to the vacuum pump and provides the visual indicator for water delivery to the upper ports in the electrode chamber. This visual indicator is used to establish timing for water and vacuum valve openings and closings needed to prepare for the forming operation. An accumulator provides water at rates exceeding the pump capacity in between forming discharges and maintains design pressure to the electrode chamber.

The hydroforming subsystem described above may be used for partially forming the blank 20, as a pre-forming step, before the final forming steps are completed using electrohydraulic forming. Using a pre-forming step can be advantageous in terms of process cycle time since a pre-forming step can be accomplished in only 15 seconds, whereas the steps that it replaces can require 75-90 seconds. While hydroforming is a superior forming method for the initial forming steps, the final forming steps can only be accomplished through EHF, because very high strain rates and substantial pressure are necessary for forming the sheet metal blank completely into deep die cavities. Check valves and solenoid valves may be required to shield the other components of the water/air management system from the hydroforming pressures.

The electrode chamber may be filled to within 10 mm of the top edge of the binder 26 prior to inserting the blank 20. The blank 20 may then be inserted and the press can be closed. A vacuum pump capable of reaching a vacuum adequate to boil water at room temperature can evacuate the volume of air from between the surface of the water and the underside of the blank 20, and also simultaneously evacuate air from the binder cavity 28 between the upper surface of the blank 20 and the die surface. These two volumes may be evacuated simultaneously to prevent differential pressures from deforming the blank 20 by being sucked toward the vacuum source 64.

After air evacuation, the space below the blank 20 may be left containing low pressure water vapor only. The water supply valve can then be opened and the newly created portion of the electrode chamber filled with liquid. When the level reaches the vacuum ports and liquid water is determined in the separator 86, the vacuum supply valve to the space below the blank 20 can be closed and water can then fill in the evacuated volume. A flow meter, which determines in real time the volume of water added to the chamber, will indicate when the filling is completed. The vacuum supply can then be connected to the space above the blank 20 to evacuate the air which would otherwise be compressed by the forming operation. This vacuum should be as deep as is possible. Any air remaining in this volume can impede the high speed forming event. After a deep vacuum has been established above the blank 20, the forming steps can commence.

The blank 20 is now ready to be pre-formed using static hydroforming pressure in the water. Water can now be pumped into the chamber using the hydroforming pump, until the optimal maximum static pressure is reached. This maximum pressure will vary from part to part and will depend on the geometry and draw depth of each specific part. Proper high pressure valves and hoses may be necessary to deliver pressurized water to the chamber without harming other components in the water/air management system. After the pre-forming step is complete, the static pressure in the chamber can be bled off through bleed valves.

The final forming increments can now be accomplished using EHF. The blank may be forced into the die cavity by a pressure wave formed by an electrical discharge between the submerged electrodes 16, 18. With each successive discharge the volume inside the electrode chamber increases as the blank 20 is pressed into the die. This volume may be automatically replaced by pressurized water from the supply system. Higher chamber water pressures, such as 30-100 psi, can suppress arc formation between the electrodes 16, 18, and therefore lower the probability of a good discharge.

The electrical discharge is created by connecting a bank of high voltage capacitors to the electrodes 16, 18. The system may deliver up to 100,000 Amperes from a starting charge voltage of 15,000 volts but higher voltage systems may be employed. Stray losses aside, this discharge is governed by $I=C[dV/dt]$, where I is the current, C is capacitance, and $[dV/dt]$ is the time derivative of voltage. Ignitron or solid state switches that start the discharge may be controlled by a programmable operating system. This operating system may control multiple discharges at various power levels from a single 'START' command. The physical properties of the blank and geometry of the die 24 may dictate the regime of discharges used in the forming process. Through Programmable Logic Controller (PLC) (not shown) of the pulsed current generator, the entire EHF process can be automated so as to optimize process cycle time. Any number of process steps may be done concurrently, such as chamber back filling done in parallel with capacitor charging and discharging to reduce cycle time. Also vacuuming can be done in parallel with charging the capacitors and filling the binder are with liquid.

When the forming sequence is completed, the die opening process may be initiated. The die water supply valve is closed and the vacuum pump is shut down and the separator vent valve is opened. Before the press can be opened, the water added to fill the additional chamber volume must be removed, or otherwise spillage would occur. The fastest and most efficient way to remove this water is to pump pressurized air into the chamber and to force water out of the vacuum port and into the separator 86. Once water is no longer flowing into the separator 86 but instead only pressurized air, it is then confirmed that the water level is low enough for the dies to be opened. The press is then opened and the formed blank 20 is removed. The total time necessary for die filling, part forming, and die draining is merely dependent upon the supply pump capacity, the vacuum pump capacity, the size and power of the transformers which charge the capacitors, the drain pump capacity, and the flow and pressure limitations of the tubing and/or piping which carries water to and from the dies.

Figure 7:
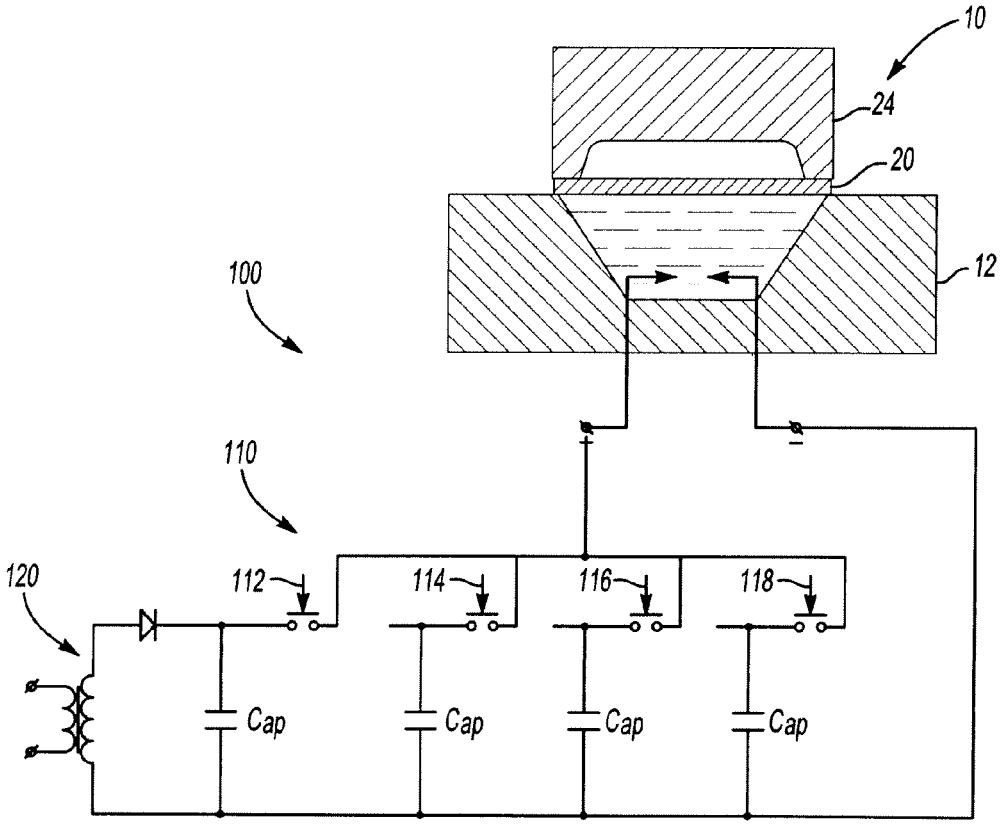
FIG. 7 illustrates a high voltage discharge system that may be used with the tool in accordance with one non-limiting aspect of the present invention

FIG. 7 illustrates a high voltage discharge system 100 that may be used with the tool 10 in accordance with one non-limiting aspect of the present invention. The discharge system 100 may include a number of capacitors configured to reduce timing delays between successive shockwaves. Rather than using a single capacitor to discharge the electrodes, a bank of capacitors 110 may be individually discharged with the control of a number of switches 112, 114, 116, 118. This allows a subsequent discharge to occur without waiting for the capacitor associated with the previous discharge to be recharged. A transformer 120 may be included to charge one or more of the capacitors at the same time. The capacitors may be charged in parallel, and then discharged sequentially at a desired time schedule. Each set may be charged to an individual voltage by disconnecting capacitors from the charging device after achieving the targeted charging voltage.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

What is claimed:

1. An electrohydraulic forming (EHF) method for forming a sheet metal blank in a EHF tool that has (1) a vessel defining a vessel cavity having an opening on an upper end, (2) at least two electrodes disposed within the vessel cavity, (3) a binder disposed above the opening in the vessel, the binder holding a bottom side of the blank, wherein a binder cavity is defined by the blank, the binder, and the upper end of the vessel, and (4) a forming die disposed above the binder, the forming die holding a top side of the blank, the forming die having a die cavity that is partially defined by a forming surface, the method comprising:

filling the vessel cavity at least up to the upper end with a liquid;

evacuating air from the binder and die cavities;

producing a high voltage discharge between the electrodes that induces a shockwave in the liquid, the shockwave forming the blank against the forming surface in the die cavity.

2. The method of claim 1 further comprising pre-forming the blank prior by filling the binder cavity with liquid to a pressure sufficient to pre-form at least a portion of the blank at against the forming surface in the die cavity.

3. The method of claim 2 further comprising bleeding a portion of the liquid from the binder cavity prior to inducing the shockwave and after pre-forming the blank.

4. The method of claim 1 further comprising facilitating removal of the formed blank by draining the liquid below the upper end of the vessel.

5. The method of claim 1 further comprising facilitating removal of the formed blank by draining the liquid below the upper end of the binder but not below the upper end of the vessel.

6. The method of claim 1 further comprising facilitating removal of the formed blank by assisting drainage of the liquid with fluid injected under pressure into an area below the blank.

7. The method of claim 1 further comprising re-forming the blank prior to draining liquid from the vessel and without detaching the binder from the die by inducing another shockwave that re-forms the blank against the forming surface in the cavity.

8. The method of claim 7 further comprising continuously evacuating air from the die cavity to equalize pressure on either side of the blank.

9. The method of claim 7 further comprising re-filling a forming cavity created above the binder cavity during forming of the blank with the liquid prior to re-forming the blank.

10. The method of claim 1 further comprising simultaneously evacuating the air and filling the liquid.

11. An electrohydraulic forming (EHF) tool for forming a sheet metal blank comprising:

a vessel defining a vessel cavity having an opening on an upper end;

at least two electrodes disposed within the vessel cavity;

a binder disposed above the opening in the vessel, the binder holding a bottom side of the blank, wherein a binder cavity is defined by the blank, the binder, and the upper end of the vessel;

a forming die disposed above the binder, the forming die holding a top side of the blank, the forming die having a die cavity that is partially defined by a forming surface;

a liquid source operatively connect to the vessel that fills the vessel and binder cavities with liquid; and a high voltage source operatively connected to the two electrodes that selectively provides a high voltage discharge to the electrodes, wherein the high voltage discharge produces a shockwave in the liquid that forms the blank against the forming surface in the die cavity.

12. The EHF of claim 11 further comprising a die vacuum port that opens into the die cavity adjacent an upper most portion of the form surface and that is ported to a vacuum source.

13. The EHF of claim 11 further comprising a binder vacuum port that opens into the binder cavity adjacent an upper most portion of the binder and that is ported to a vacuum source.

14. The EHF of claim 11 further comprising a liquid supply port operatively connected to the liquid source for controllably supplying and removing liquid from the vessel.

15. The EHF of claim 11 further comprising a vacuum source that simultaneously evacuates air from the binder and die cavities.

16. An electrohydraulic forming (EHF) method for forming a blank with a tool having a vessel being filled with a liquid and forming die, the method comprising:

pre-forming the blank against the die with pressure generated from the liquid-filled vessel;

bleeding pressure from the tool; and creating a shockwave within the liquid to generate a force to form the blank against the die.

17. The method of claim 16 further comprising, after forming the blank, re-filling the vessel with liquid to a level above an upper end of the vessel and forming the blank against the die with force generated from another shockwave created within the liquid.

18. The method of claim 16 further comprising draining the liquid that is at the level above the upper end of the vessel, including injecting pressurized fluid into the die to facilitate draining the liquid.

19. The method of claim 18 further comprising monitoring an amount of liquid used to re-fill the vessel to determine if additional forming steps are required to completely form the blank.

20. The method of claim 16 further comprising forming the blank with successive discharge voltages being supplied from different capacitors included within a capacitor bank.

* * * * *